United States Patent [19]

Boothe

[11] 4,237,589

[45] Dec. 9, 1980

[54] GRINDING DISC

[76] Inventor: Leland H. Boothe, 251 S. 600 East, Alpine, Utah 84003

[21] Appl. No.: 27,001

[22] Filed: Apr. 4, 1979

Related U.S. Application Data

[60] Continuation of Ser. No. 873,126, Jan. 30, 1978, abandoned, which is a division of Ser. No. 743,862, Nov. 22, 1976, Pat. No. 4,085,899.

[51] Int. Cl.[3] ..... B02C 7/13

[52] U.S. Cl. ..... 241/296; 241/261.3

[58] Field of Search ..... 241/261.2, 261.3, 296, 241/298

[56] References Cited

U.S. PATENT DOCUMENTS

| | | | |
|---|---|---|---|
| 203,100 | 4/1878 | Ames et al. | 241/296 X |
| 1,183,350 | 5/1916 | Dellniger | 241/296 |
| 1,556,323 | 10/1925 | Garza | 241/298 |
| 1,778,860 | 10/1930 | Lindenfelser | 241/298 |

*Primary Examiner*—Howard N. Goldberg

*Attorney, Agent, or Firm*—Thorpe, North, Western & Gold

[57] ABSTRACT

A grinding disc for use with grinding apparatus adapted to grind grain and the like. The grinding disc includes an opening centrally located therein, with the perimeter of the opening forming a plurality of teeth projecting toward the center of the disc. The teeth are separated by generally horseshoe-shaped notches. The grinding disc further includes a plurality of groups of channels on one face thereof defining grinding ridges therebetween and extending from near the periphery of the disc inwardly to the opening in the disc. Certain of the channels in each group intersect with certain other channels in at least one other group to form a cross-hatching of channels.

2 Claims, 4 Drawing Figures

GRINDING DISC

This is a continuation, of application Ser. No. 873,126, filed Jan. 30, 1978, now abandoned. Which was a division of application Ser. No. 743,862 filed Nov. 22, 1976 now U.S. Pat No. 4,085,899, Apr. 25, 1978.

BACKGROUND OF THE INVENTION

This invention relates to grain grinding apparatus.

Interest in grain grinders for home use has increased in recent years giving rise to the design and development of a number of different types of grinding apparatus. Examples of such prior art grinders are described in U.S. Pat Nos. 3,638,871, 3,880,367 and 3,688,996. Although the prior art grinding mills appear suitable for grinding grains, they oftentimes are bulky, complicated and expensive.

It is an object of the present invention to provide an inexpensive and simple to produce grinding apparatus for grinding grains and the like.

It is still another object of the present invention, in accordance with another aspect thereof, to provide grinding apparatus having a pair of mutually facing grinding discs with a cutting teeth and ridge construction which facilitates more rapid and cooler grinding of material.

SUMMARY OF THE INVENTION

The above and other objects of the present invention are realized in an illustrative embodiment of a grinding disc having an opening centrally located therein. The perimeter of the opening is formed with a plurality of teeth projecting toward the center of the disc, with the teeth being separated by generally horseshoe-shaped notches. In accordance with one aspect of the invention, the face of the grinding disc is provided with cross-hatched formations of channels and grinding ridges.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
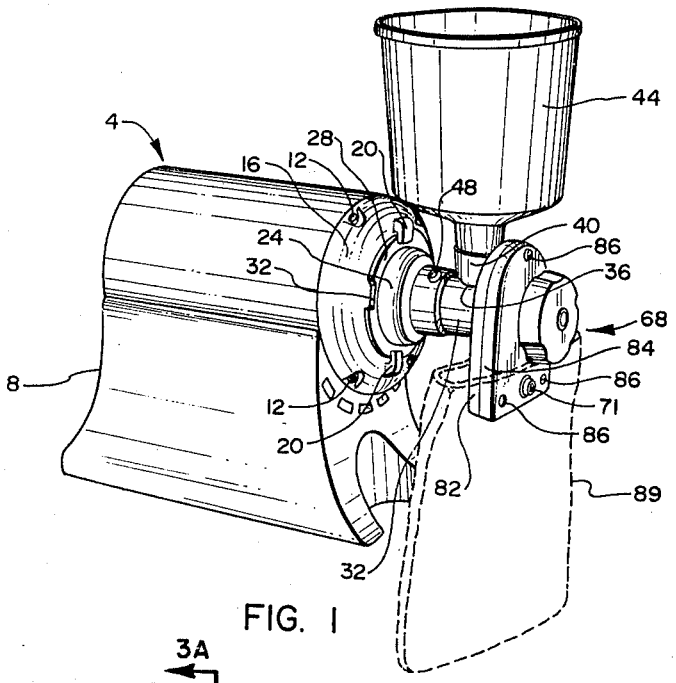
FIG. 1 shows a perspective view of grinding apparatus made in accordance with the principles of the present invention.
Figure 2:
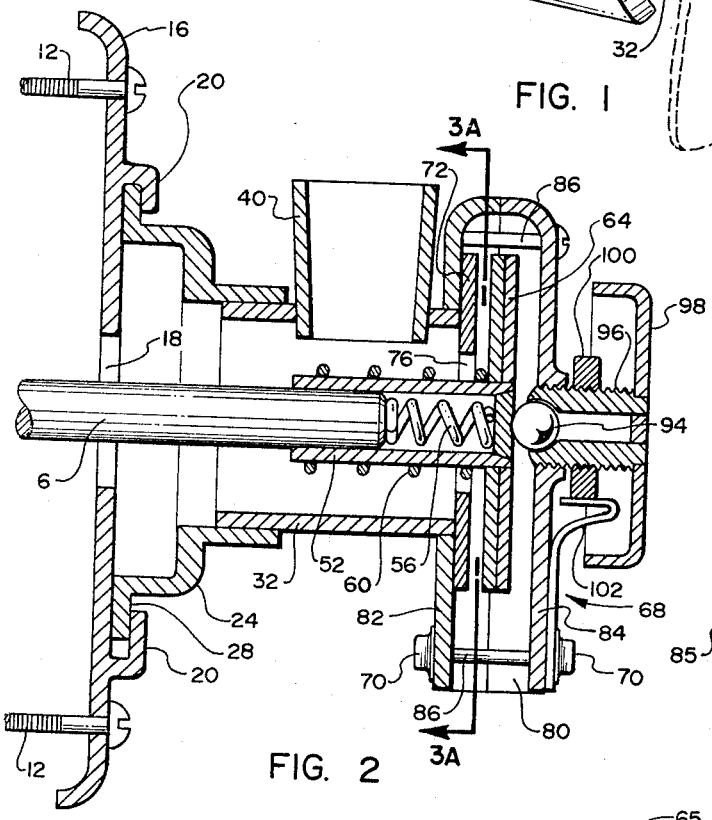
FIG. 2 shows a side elevational, cross-sectional view of the grinding apparatus of FIG. 1.

FIGS. 1 and 2 show grinding apparatus adapted for mounting on a conventional electric motor 4. The motor 4 is shown mounted on a support base 8 which is formed to cradle and hold the motor in a stable configuration, but which is not considered part of the present invention. A number of suitable arrangements for stably supporting and holding the motor 4 could be provided.

Mounted on the front of the motor 4 by bolts or screws 12 is a support plate 16. Openings in the support plates 16, for the insertion of the bolts 12, are provided to accommodate the particular motor upon which the grinding apparatus is to be mounted. Most conventional motors include threaded bores into which bolts 12 can be screwed for mounting the support plate 16. If threaded bores are not present, they can be readily provided. An opening 18 is located centrally in the support plate 16 to enable the extension therethrough of a drive shaft 6 of the motor 4. Extending outwardly and then towards one anouther from the front face of the support plates 16 are tabs 20. The tabs 20 are positioned to secure on the support plate 16 and over the opening 18 in the plate a collar member 24. Plastikat Manufacturing Co., Inc. of Lodi, Calif. produces a juicer which includes a motor and support plate configuration substantially as described and on which the grinding apparatus to next be described can be mounted.

The collar member 24 includes a lip 28 extending laterally from the collar member over which the tabs 20 fit to secure the collar member on the support plate 16. A pair of notches 32 (only one of which is shown in FIG. 1) are located in the lip 28 to enable fitting the collar member 24 between the tabs 20 and against the support plate 16. In other words, the collar member 24 is oriented in front of the support plate 16 so that the notches 32 are aligned with the tabs 20 to enable moving the collar member toward the support plate 16 in between the tabs. As the collar member 24 is moved toward the support plate, the tabs 20 pass through the notches 32 and then after the lip 28 is positioned against the front surface of the plate 16, the collar member 24 is rotated so that the notches 32 are no longer aligned with the tabs 20 and the tabs 20 press against and hold the lip 28 and thus the collar member 24.

Fitted into the end of and extending outwardly from the collar member 24 is a tubular member 32. An opening 36 (FIG. 1) is located in the top of the tubular member 32 for insertion of a funnel 40. A larger receiving funnel 44 is also provided for insertion in the smaller funnel 40. Grain or other material to be ground is then poured into the larger funnel 44 and directed through the smaller funnel 40 into the tubular member 32. The tubular member 32 may be held in place in the end of the collar member 24 by means of a set screw 48.

Fitted over the end of the motor drive shaft 6 is a hollow support shaft 52, in which is positioned a coil spring 56 for urging the support shaft outwardly from the end of the drive shaft 6. That is, when the support shaft 52 is placed on the end of the drive shaft 6, the coil spring 56 contacts the end of the motor drive shaft 6 to urge the support shaft 52 outwardly. A grinding disc 64 is mounted on the outer end of the support shaft 52 and an auger 60, which could be in the form of a coil of wire, is provided on the exterior surface of the support shaft. The function of the auger 60 is to move material inserted through the funnel 40 toward the grinding disc 64 as the motor drive shaft 6, and thus support shaft 52, are rotated. A spline is formed in the drive shaft 6 to fit within a corresponding channel on the inside of the support shaft 52 (or vice versa) to prevent the support shaft from rotating relative to the drive shaft.

Mounted on the outer end of the tubular member 32 is a skirt structure 68 which is formed to fit over and about the grinding disc 64. Mounted on the inside surface of a portion of the skirt 68 is a second gringing disc 72 (FIG.2). The grinding disc 72 includes an opening 76 to enable communication between the interior of the tubular member 32 and the space between the grinding discs 64 and 72. As indicated earlier, the auger 60 formed on the exterior surface of the support shaft 52 functions to move grain and the like toward the grinding disc 64 and thus between the two grinding discs. As will be discussed later, the facing sides or faces of the grinding discs 64 and 72 are formed with grinding teeth and ridges for grinding grains introduced therebetween.

The skirt 68 encloses and surrounds the grinding discs 64 and 72 to direct ground material downwardly through an opening 80 at the bottom of the skirt into a receiving bag 89. The skirt advantageously is formed from two substantially similarly U-shaped pieces 82 and 84 which are mated along corresponding perimetric lips 85 (FIG. 3) and held together by bolts 86. Forming the skirt 68 from two pieces in this fashion facilitates manufacture and assembly of the skirt in a simple and economical manner.

Located on opposite exterior sufaces of the skirt 68 are a pair of snap elements 70 onto which corresponding snap elements 71 on the bag 89 can be "snapped" to attach the bag just below the opening 80 of the skirt for receiving ground material exiting from the opening.

Figure 4:
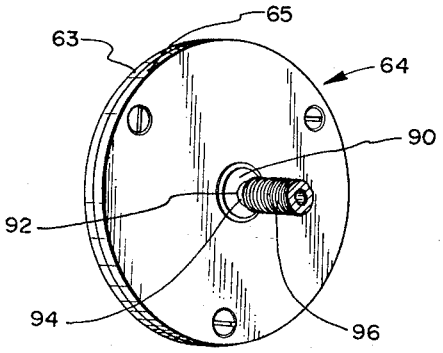
FIG. 4 is a perspective view of the back side of the rotatable grinding disc of the grinding apparatus of FIG. 2, together with a fragmented view of the adjustable bearing member of the aparatus.

Disposed on the back side of grinding disc 64 is a bearing element 90 which may be made of a graphite material. The bearing element 90 is simply a small disc formed with a small depression 92 in the center thereof (FIG. 4) for receiving a ball-shaped bearing member 94. The bearing member 94 is disposed in the end of a hollow threaded shank 96 which is screwed into a threaded opening in piece 84 of the skirt 68. Mounted on the other end of the threaded shank 96 is a handle or knob 98 to enable turning the shank. The ball-shaped bearing member 94 is aligned with the bearing element 90 to contact the bearing element and thereby maintain the support shaft 52 on the ends of the motor drive shaft 6. The coil spring 56 contained in the support shaft 52, in turn, biases the support shaft outwardly to cause the bearing element 90 to press against the bearing member 94. The threaded shank 96 may be screwed into or out of the threaded opening in the skirt 68 to thereby mve the grinding disc 64 either toward or away from the grinding disc 72. In this manner, the spacing between the grinding discs can be adjusted to provide for either a course or fine grinding of the material to be ground.

A nut 100 is positioned on the exterior surface of the threaded shank 96 to contact the outer surface of the skirt 68 when the threaded shank is screwed into the threaded opening in the skirt 68 a certain distance. When the nut 100 contacts the exterior surface of the skirt 68, the threaded shank is prevented from being screwed any further to thus limit the movement of the grinding disc 64 toward the grinding disc 72. A leaf spring 102 is mounted on the exterior of piece 84 of the skirt 68 to contact the edge of the nut 100 and thereby function as a detent for the turning of the knob 98.

The ball-shaped bearing member 94 is loosely disposed in the end of the threaded shank 96 so that it may freely rotate as well as move laterally within the shank some degree. That is, the ball-shaped bearing member may move within the threaded shank 96 to find the center of rotation of the bearing element 90 to thereby provide support and stability for the grinding disc 64. The bearing member 94 will normally move into the depression 92 located in the bearing element 90 to provide the desired stability in the rotation of the grinding disc 64. Construction of the bearing element 90 of a graphite material enables self-lubrication of the contact surfaces between the bearing element 90 and the bearing member 94.

Figure 3:
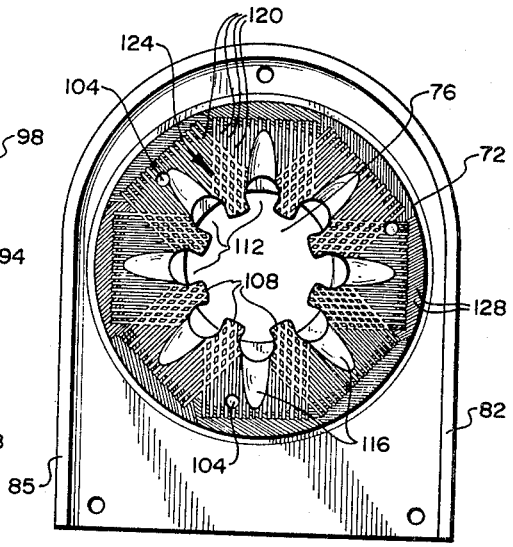
FIG. 3 is a view taken along lines 3A—3A of FIG. 2.

Referring to FIG. 3, which is a view taken along lines 3A—3A of FIG. 2, there is shown piece 82 of the skirt 68, and the grinding disc 72 which is mounted on the piece by screws 104. As indicated earlier, there is an opening 76 in the grinding disc 72 and in the piece 82 of the skirt. The perimeter of the opening in the grinding disc 72 is formed to present a plurality of grinding teeth 108 which extend radially inwardly as shown. Horseshoe-shaped notches 112 are provided between the grinding teeth 108 to allow the flow thereinto of material to be ground. When the material moves into a notch, rotation of the grinding disc 64 (which is formed with grinding teeth and notches similar to the grinding disc 72) coacts with the grinding disc 72 to cut and crush the material. Provision of horseshoe-shaped notches 112 facilitates trapping and holding the material in the notches so that it can be cut and crushed.

Extending from near the periphery of the grinding disc 72 to each of the notches 112 are a plurality of circumferentially spaced grooves 116. These grooves allow for the movement of grains or the like therethrough to further enable the grinding of the material. The width of the grooves 116 is greatest where the grooves meet the notches 112 and from there the grooves narrow until they terminate.

Formed in the grinding face of the disc 72 are a plurality of group of channels 120 extending from near the periphery of the disc inwardly to define grinding ridges therebetween. The channels 120 are formed to intersect with one another to thereby form cross-hatched patterns of channels 124. The cross-hatched portions are located on the faces of the grinding teeth 108. By providing channels which extend from near the center of the disc outwardly in more than one direction facilitates more rapid grinding of the material while maintaining the material at a cooler temperature. This is because more pathways are provided for the ground material to move outwardly for ultimate discharge. As can be seen from FIG. 3, there are eight groups of channels 120 spaced about the opening 76 in the disc, with the channels in each group being generally parallel to one another, and being generally colinear with the channels of the group disposed on the opposite side of the opening.

A plurality of circumferentially spaced channels and grinding ridges 128, of smaller dimension than the channels 120, are formed to extend from near the outer terminations of the channels 120 outwardly to the periphery of the disc as shown in FIG. 3. These channels and ridges provide for a more refined grinding of the material and for ultimate discharge thereof.

The grinding disc 64 is of the same construction as in grinding disc 72 and may, for example, be constructed of a grinding piece 63 (FIG. 4) formed with an opening in the center thereof, and a solid backing piece 65 on which the grinding piece is mounted. The bearing element 90 is then mounted on the backing piece 65.

It is to be understood that the above described arrangement is only illustrative of the application of the principles of the present invention. Numerous mdifications and alternative arrangements may be devised by those skilled in the art without departing from the spirit and scope of the present invention and the appended claims are intended to cover such modifications and arrangements.

What is claimed is:

1. A grinding disc for use in combination with grinding apparatus for grinding grains and the like, said disc including an opening centrally located therein, the perimeter of the opening forming a plurality of teeth projecting toward the center of the disc, said teeth being separated by generally horseshoe-shaped notches, and a plurality of groups of channels on one face thereof, defining grinding ridges therebetween and extending from near the periphery of the disc inwardly to the opening in the disc, certain of said channels in each group intersecting with certain other of said channels in at least one other group to form a cross-hatching of channels, the channels and ridges in each group being formed generally parallel to one another and generally colinear with the channels and ridges of a corresponding group disposed on the opposite side of the opening.

2. The grinding disc of claim 1 further including a plurality of circumferentially spaced grooves formed in said one face of the disc to extend from said notches radially outwardly, said grooves being wider and deeper than said channels.

* * * * *